US005645213A

United States Patent [19]

Focke et al.

[11] Patent Number: 5,645,213

[45] Date of Patent: Jul. 8, 1997

[54] HINGE-LID BOX FOR CIGARETTES OR THE LIKE

[75] Inventors: Heinz Focke; Harald Gosebruch, both of Verden, Germany

[73] Assignee: Focke & Co. (GmbH & Co.), Verden, Germany

[21] Appl. No.: 531,850

[22] Filed: Sep. 21, 1995

[51] Int. Cl.[6] ..... B65D 43/14

[52] U.S. Cl. ..... 229/160.2; 206/273; 229/146

[58] Field of Search ..... 229/160.2, 146; 206/268, 273

[56] References Cited

U.S. PATENT DOCUMENTS

| | | | |
|---|---|---|---|
| 2,163,828 | 6/1939 | Chalmers | 229/146 |
| 3,173,600 | 3/1965 | Michalka | 229/146 |
| 3,486,682 | 12/1969 | Mahon et al. | 229/146 |
| 3,693,865 | 9/1972 | Desmond et al. | 229/146 |
| 4,526,317 | 7/1985 | Cassidy | 229/146 |

FOREIGN PATENT DOCUMENTS

| | | |
|---|---|---|
| 560403 | 9/1957 | Belgium . |
| 1538536 | 9/1968 | France . |
| 7711856 | 5/1978 | Netherlands . |
| 507998 | 6/1939 | United Kingdom . |
| 1143230 | 2/1969 | United Kingdom . |
| 1248131 | 9/1971 | United Kingdom . |

*Primary Examiner*—Gary E. Elkins
*Attorney, Agent, or Firm*—Abelman, Frayne & Schwab

[57] ABSTRACT

A hinged-lid box for cigarettes or the like, and a blank for producing the box from thin cardboard, includes a hinge of Z-bold configuration for pivotally attaching the lid to the rear wall so that in the closed position the lid encloses and overlaps an upper region of the box.

7 Claims, 4 Drawing Sheets

HINGE-LID BOX FOR CIGARETTES OR THE LIKE

DESCRIPTION

Figure 1:
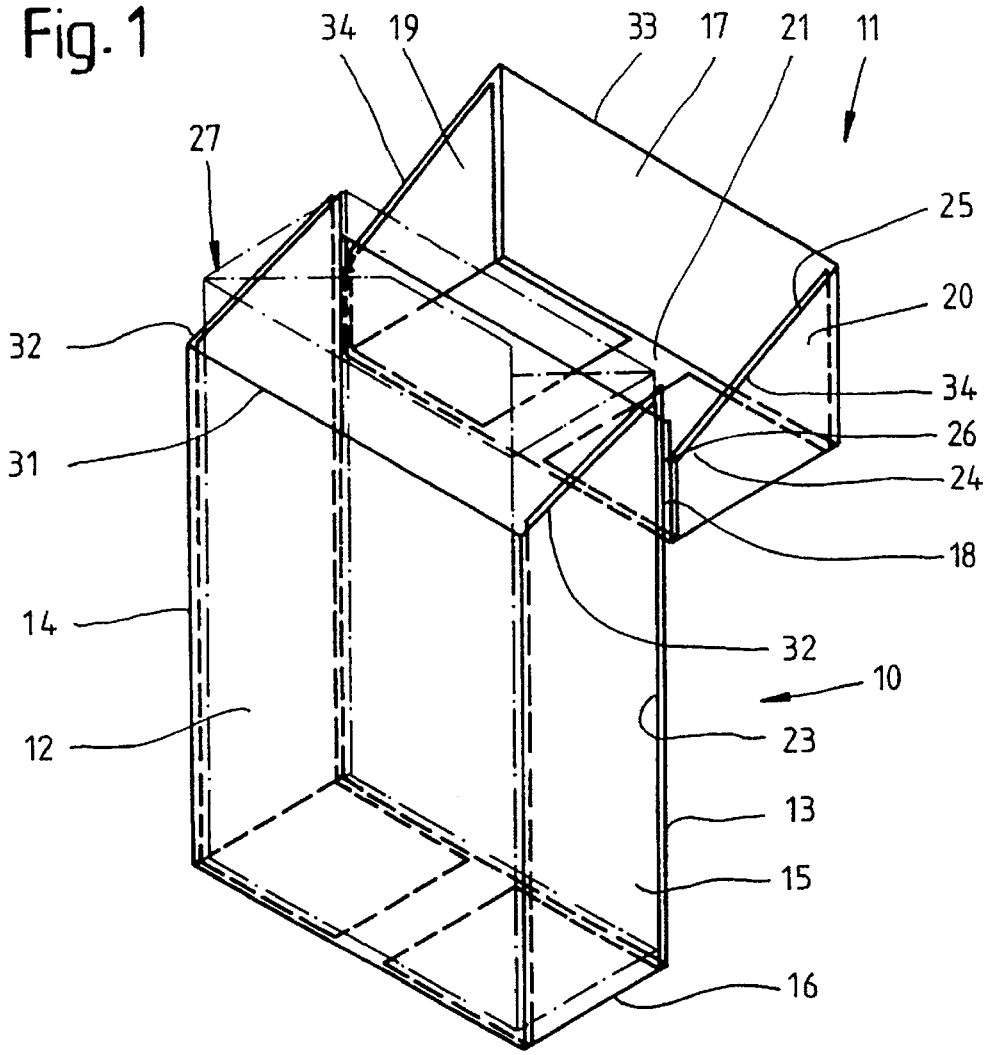

The invention relates to a hinge-lid box of thin cardboard for cigarettes and other articles which are to be packaged, the hinged-lid box having a box part comprising box front wall, box rear wall, box side walls and base wall, lid side a lid comprising lid front wall, lid rear wall, lid side walls and end wall, the lid being connected pivotably to the box rear wall in the region of the lid rear wall via a transversely directed hinge line.

The invention further relates to a blank for producing hinge-lid boxes having the above features.

The use of hinge-lid boxes as packaging for cigarettes is widespread throughout the world. The standard construction of a hinge-lid box or hinge-lid pack is such that box part and lid are connected to one another in a hinged manner in the region of box rear wall and lid rear wall by a transversely directed hinge line. Arranged in the box part is a collar which projects out of said box part and extends in the region of the box front wall and of the box side walls. That region of the collar which projects out the box part is enclosed by lid front wall and lid side walls in the closed position.

The outlay in terms of materials for hinge-lid boxes of this configuration is considerable, in particular due to the collar fabricated from a separate blank. The attachment of said collar also causes additional outlay in terms of packaging during the manufacture of the hinge-lid boxes.

The object of the invention is to propose a hinge-lid box with improved properties and a lower degree of outlay in terms of materials and manufacturing.

In order to achieve this object, the hinge-lid box according to the invention is characterized in that, by virtue of the formation of a fold in the region of the lid rear wall and/or of the box rear wall, the hinge line is offset downwards into a lower region of the box rear wall, and in that the lid, with the lid front wall and the lid side walls, covers over the outside of an upper region, directed towards them, of box front wall and box side walls.

The inventive configuration of the hinge-lid box makes it possible to dispense with the use of a collar. The necessary overlapping of the lid in the closed position is ensured in that a lower edge sub-region or border region of the lid front wall and lid side walls overlaps box front wall and box side walls in the upper edge or border regions thereof. This ensures an effective closed position. The opening of the hinge-lid box is made easier since, in the region of lid front wall and lid side tabs, the lid rests on the corresponding upper walls of the box parts and can thus be more easily gripped.

The entire hinge-lid box is manufactured from a single-piece blank, in the case of which punch cuts are to be provided, as an additional measure, in the region of the box rear wall and/or of the lid rear wall, in order to release the folding regions, in particular for a Z-fold.

The hinge-lid box designed according to the invention may be enclosed by an outer wrapper of cellophane or a polymer film. However, the hinge-lid box is also particularly well suited for recently available cigarette packs without an outer wrapper.

Further features of the invention relate to the design of the (Z-) fold in the region of the rear side of the hinge-lid box and to the configuration of border edges of the lid and of the hinge-lid box.

Figure 2:
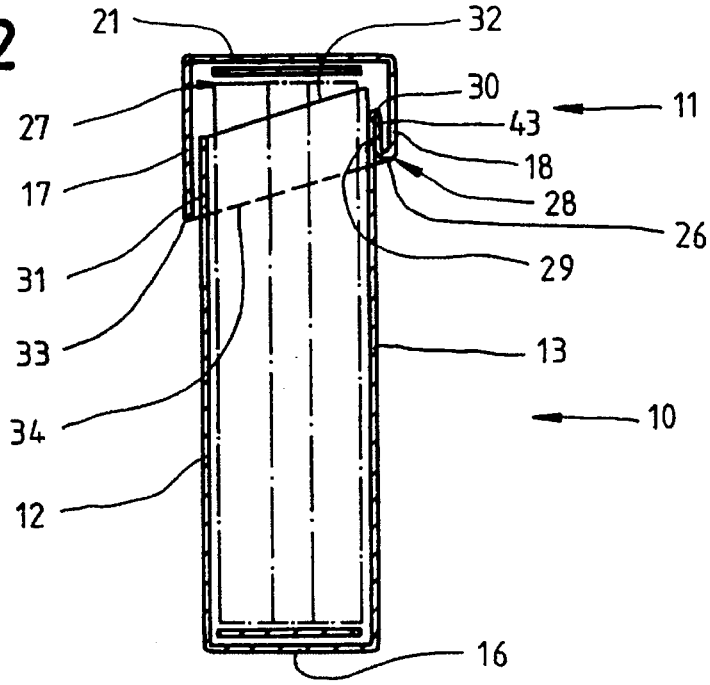
Figure 3:
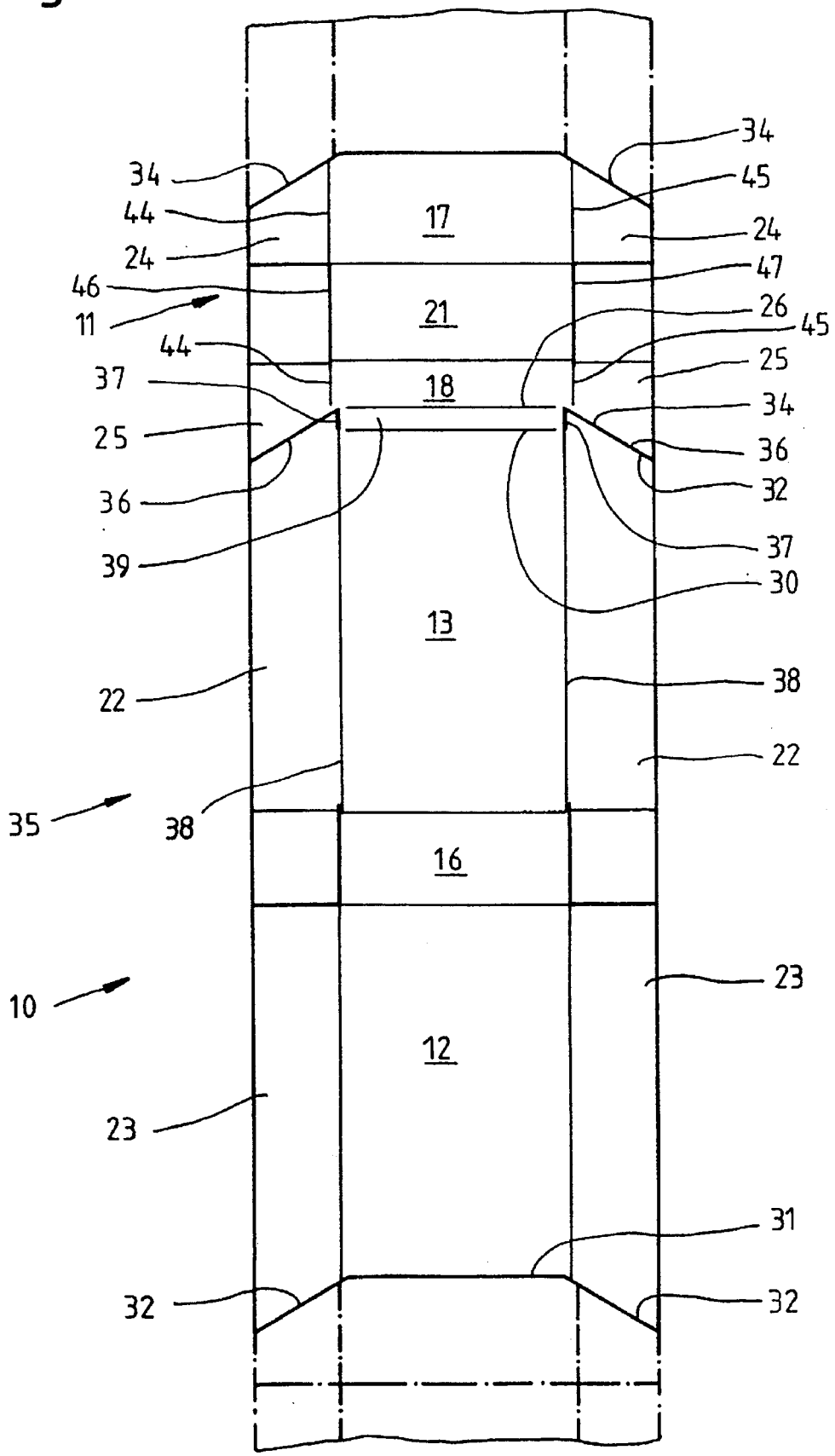
Figure 4:
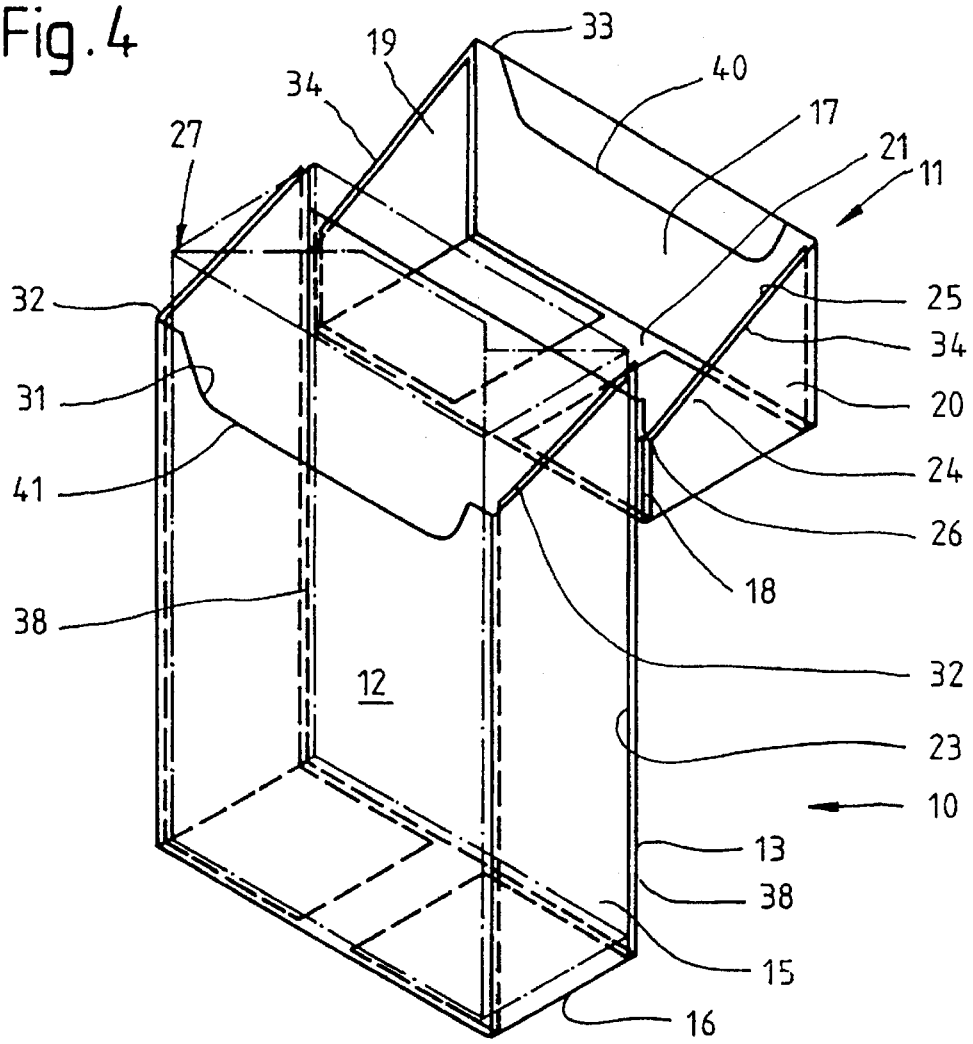
Figure 5:
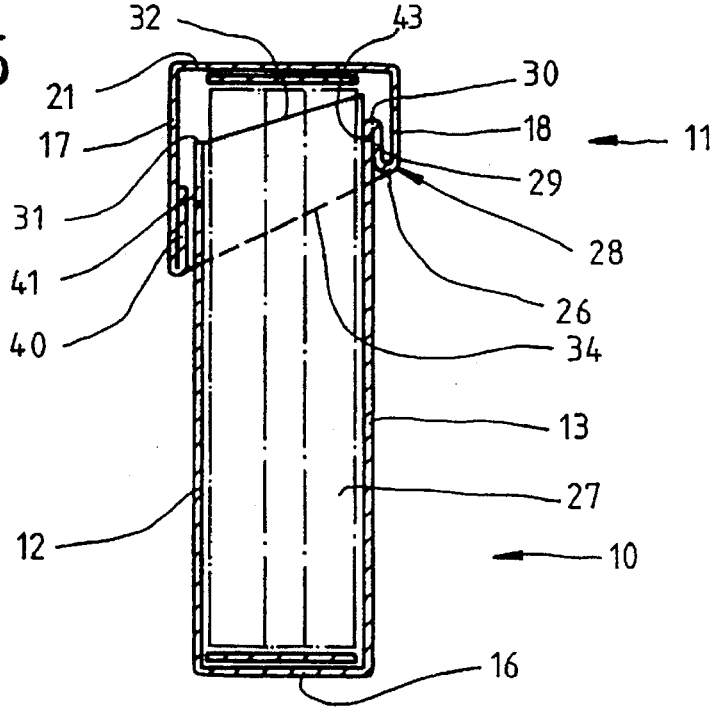
Figure 4:
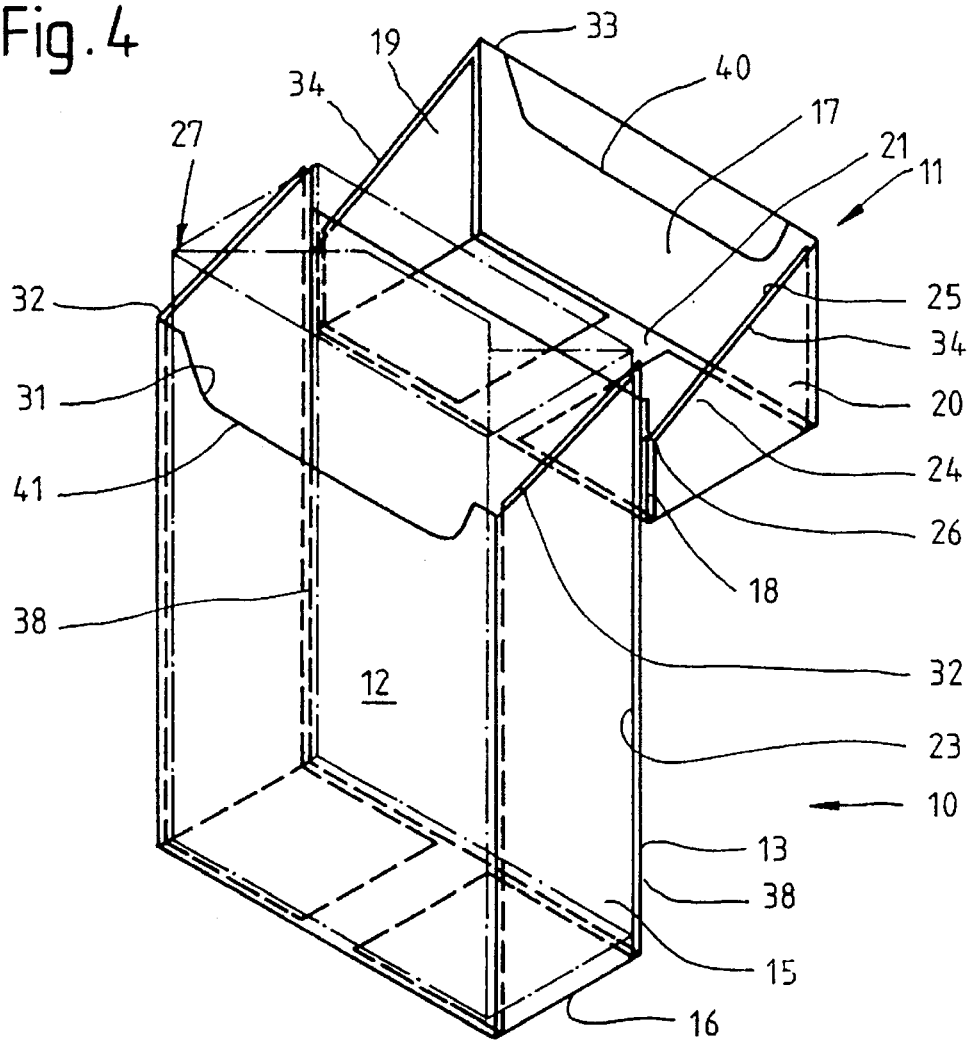
Figure 5:
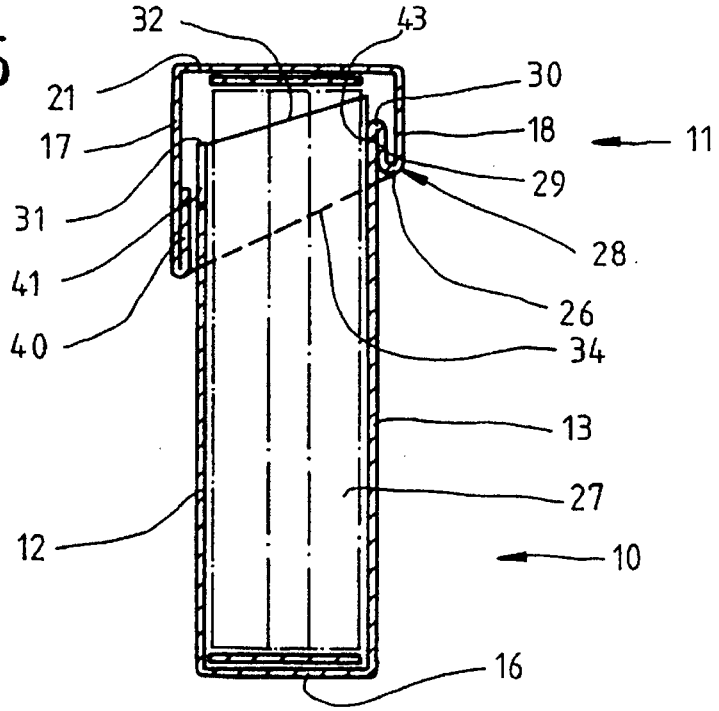

Exemplary embodiments of the hinge-lid box according to the invention are explained in more detail hereinbelow, with reference to the following drawings in which:

FIG. 1 shows a perspective representation of an open hinge-lid box,

FIG. 2 shows a vertical section through the closed hinge-lid box according to FIG. 1, FIG. 3 shows a portion of a material web with a blank for a hinge-lid box according to FIGS. 1 and 2, FIG. 4 shows another embodiment of a hinge-lid box in a representation analogous to FIG. 1, FIG. 5 shows a vertical section through the hinge-lid box according to FIG. 4, in the closed position, and FIG. 6 shows a portion of a material web with a blank for a hinge-lid box according to FIGS. 4 and 5.

The exemplary embodiments of hinge-lid boxes which are represented in the drawings comprise a box part 10 and a lid 11. The box part 10 comprise a box front wall 12, a box rear wall 13, narrow, upright box side walls 14, 15 and a base wall 16.

The lid 11 comprises a lid front wall 17, an opposite lid rear wall 18, lid side walls 19, 20 in extension of the box side walls 14, 15 (when the hinge-lid box is closed) and an end wall 21 opposite the base wall 16. The box side walls 14, 15 comprise mutually overlapping box side tabs 22, 23 which are connected to one another by adhesive bonding. The lid side walls 19, 20 are formed from lid side tabs 24, 25 which are adhesively bonded to one another.

Box part 10 and lid 11 are connected pivotably to one another in the region of box rear wall 13 and lid rear wall 18 via a transversely running joint or a hinge fold line 26 which is formed by embossing the material. The hinge line 26 extends over the entire width of the box rear wall 13 and lid rear wall 18. The dimensions of box part 10 and lid 11 are selected such that the pack contents, namely a cigarette group—cigarette block 27—enclosed by an inner wrapper is seated in the box part 10 and projects out of the latter as an upper end region. In the closed position of the hinge-lid box, said upper end region is enclosed by the lid 11.

The lid 11 is arranged and dimensioned such that, in the closed position of the hinge-lid box, an upper end region of the box part 10 is enclosed by the lid 11, namely by the lid front wall 12, lid rear wall 13 and lid side walls 14, 15. The proportions are selected such that it is possible to open and close the lid without any constraints. For this purpose, the lid 11 is positioned further downwards in relation to conventional hinge-lid boxes, with the result that closure edges of box part 10 and lid 11 do not—as is otherwise usual—butt against one another in the closed position.

In order to permit the depicted relative position of the lid 11, the hinge line 26 is offset downwards, that is to say in the direction of the base wall 16. Said relative position is made possible by a fold in the rear region of the hinge-lid box. In the case of the present exemplary embodiment, this is a Z-shaped fold, that is to say a Z-fold 28. The latter is formed in the region of box rear wall 13 and lid rear wall 18. The hinge line 26 is offset downwards by a folding leg 29, as a result of which the relative position of the entire lid 11 is correspondingly changed. Accordingly, the folding leg 29 is bounded at the bottom by hinge line 26 and at the top by a folding edge 30. In this region, the folding leg 29 adjoins the box rear wall 13. The folding leg 29 is connected permanently to the box rear wall 13, in particular by adhesive bonding 43. During opening and closing of the lid 11, the folding leg 29 thus remains resting firmly against the box rear wall 13.

In the case of this configuration of a hinge-lid box, an otherwise conventional collar is not necessary. The box part 10 is configured such that the upright walls are of a greater height than is usual. The box rear wall 13 extends virtually to the upper end of the cigarette block 27. Upper closure edges, namely a transversely directed box front edge 31 and box side edges 32 which rise obliquely towards the box rear wall 13 run at a small distance from the upper boundary of the cigarette block 27. The walls of the lid 11 are designed to be somewhat larger and wider than in the case of conventional hinge-lid boxes, with the result that they can enclose the upper region of the box part 10. In the closed position, a lid front edge 33 runs parallel to the box front edge 31, but offset downwards. Lid side edges 34 likewise run obliquely, to be precise parallel to the box side edges 32 in the closed position.

A blank 35 for a hinge-lid box of this type is designed in a single piece and can, as is shown in FIGS. 3 and 6, be manufactured from a continuous material web by virtue of corresponding transversely directed separating cuts. The blank 35 is an elongate arrangement, in the case of which box front wall 12, base wall 16, box rear wall 13, lid rear wall 18, end wall 21 and box front wall 17 are bounded successively from one another by a transversely directed folding line.

A material strip 39 which corresponds to the folding leg 29 of the Z-fold 28 is formed between box rear wall 13 and lid rear wall 18. The material strip 39 is bounded laterally by separating cuts, namely by separating legs 37. These run in the region of longitudinally directed folding lines 38, which bound the box rear wall 13 from adjoining box side tabs 22. An obliquely directed separating line for forming the box side edges 32, on the one hand, and the lid side edges 34, on the other hand, is designed here as a continued punch line of the separating leg 37.

Folding line 44 and 45 which run in the longitudinal direction of the blank 35 and are located in the region of the lid 11 are arranged to be offset outwards with respect to the corresponding folding line 38. The same applies for punch lines 46, 47. The folding lines 44, 45 serve to bound the lid front wall 17 and the lid rear wall 18 laterally. The punch lines 46, 47 running in extension of the folding lines 44, 45 bound the end wall 21. Folding lines 44, 45 and punch lines 46, 47 are separated from one another by a greater distance than are the folding lines 38. Consequently, the walls of the lid 11 are designed with a larger width than the corresponding walls of the box part 10. The lid 11 can thus enclose the box part 10 on all sides in the upper region, without any constraints, when the hinge-lid box is closed (FIGS. 2 and 5).

In the case of the hinge-lid box according to FIGS. 1 to 3, the lid front wall 17 is of a single-layered configuration. In the case of the exemplary embodiment according to FIGS. 4 to 6, the lid front wall 17 exhibits a reinforcement, namely a lid inner tab 40, on its inner side. Said lid inner tab 40 is connected integrally to the lid front wall 17 and is folded against the inner side thereof and fixed there by adhesive bonding.

The lid inner tab 40 is part of the single-piece blank 35, to be precise part of the box front wall 12 of an adjacent blank. The box front wall 12 is thus provided, in the central region, with a depression 41 which makes it easier to remove the cigarettes from the hinge-lid box.

In order also to ensure sufficient overlapping in the region of lid front wall 17 and box front wall 12 despite the clearance 41, the lid front wall 17 is drawn further downwards in the case of this exemplary embodiment. This is achieved in that the box side edges 32, on the one hand, and the lid side edges 34, on the other hand, do not run in parallel, but diverge in the direction of the front side of the box. This produces a greater overall height of the lid front wall 17 and, correspondingly, increased overlapping. In the example, the box side edge 32 has an inclination of 15° and the lid side edge 34 has an inclination of 30°.

The blank 35 can also be produced, in the case of this exemplary embodiment, from a continuous material web (FIG. 6). Unlike the exemplary embodiment according to FIG. 3, punches for bounding the blank 35 at the ends run at an acute angle with respect to one another in the region of lid side tabs 24, on the one hand, and box side tabs 23, on the other hand. This results in a triangular punched piece 42 when the blanks are separated off from the material web.

We claim:

1. A hinged-lid box for cigarettes constructed of thin cardboard comprising a box body having a box front wall a box rear wall, box side walls and a bottom wall, and a lid having a lid front wall, a lid rear wall and lid side walls, the lid rear wall being hingedly joined at the box rear wall to an intermediate material strip which forms a Z-fold with the rear walls of the box and lid, the intermediate material strip being joined to the lid rear wall by a first transverse hinge-fold line and to the box rear wall by a second transverse fold line, said material strip positioned between the interior surface of the lid rear wall and the exterior surface of the box rear wall and bonded to the box rear wall, whereby in the closed position, the lid covers and overlaps an outside upper portion of the box.

2. The hinged-lid box of claim 1, where the ends of the intermediate material strip are separated from the adjacent box side walls.

3. The hinged-lid box of claim 2, where the upper edges of the box side walls and the lower edges of the lid side walls are inclined downwardly from their respective rear walls to their front walls, whereby the lid overlaps more of the box front wall than the box rear wall.

4. The hinged-lid box of claim 2 which further comprises a lid inner tab joined by a fold line to the lid front wall and positioned adjacent the inside of the lid front wall, and the upper edge of the box front wall has a cutout portion corresponding to the shape and size of the lid inner tab.

5. A longitudinally elongated blank for producing hinged-lid boxes of thin cardboard for packaging cigarettes, said blank comprising:

(A) a box portion comprising a box front wall, bottom wall and rear wall, said box walls joined along transverse fold lines, and box side wall elements joined to the longitudinal edges of the front, bottom and rear box walls by parallel longitudinal fold lines;

(B) a lid portion comprising a lid rear wall, top wall and front wall, said lid walls joined along transverse fold lines, and lid side wall elements joined to the longitudinal edges of the rear, top and front lid walls by parallel longitudinal fold lines; and (C) a continuous transverse material strip lying between the box rear wall and lid rear wall and separated from the adjacent box side wall elements, said transverse material strip being joined to the box and lid portions by transverse fold lines adapted to produce a Z-fold.

6. The blank of claim 5 where the parallel longitudinal fold lines in the lid portion are at a greater distance from the longitudinal axis of the blank than the parallel longitudinal fold lines in the box portion.

7. A blank according to claim 5, characterized in that said blank is separated from a continuous web of thin cardboard containing a plurality of said blanks, and wherein box side edges and lid side edges of contiguous blanks intersect at an angle with respect to one another such that a punched piece of lightweight cardboard is detached upon separation of the contiguous blanks.

* * * * *